US008308443B2

(12) United States Patent
Palecek et al.

(10) Patent No.: US 8,308,443 B2
(45) Date of Patent: Nov. 13, 2012

(54) APPARATUS AND METHOD FOR A SUBMERSIBLE PUMP SYSTEM AND LINEAR ELECTROFUSION

(76) Inventors: Gary M. Palecek, Enid, OK (US); Dennis Lee Watkins, Fairmont, OK (US)

( * ) Notice: Subject to any disclaimer, the term of this patent is extended or adjusted under 35 U.S.C. 154(b) by 559 days.

(21) Appl. No.: 12/515,162

(22) PCT Filed: Nov. 16, 2006

(86) PCT No.: PCT/US2006/044787

§ 371 (c)(1), (2), (4) Date: May 15, 2009

(87) PCT Pub. No.: WO2008/060288

PCT Pub. Date: May 22, 2008

(65) Prior Publication Data

US 2010/0054961 A1 Mar. 4, 2010

(51) Int. Cl.

| | |
|---|---|
| ***F04B 53/20*** | (2006.01) |
| ***F04B 53/00*** | (2006.01) |
| ***B23P 11/00*** | (2006.01) |

(52) U.S. Cl. ..... 417/61; 137/544

(58) Field of Classification Search ..... 417/61; 137/544; 29/888.02; 405/75, 76; 440/9
See application file for complete search history.

(56) References Cited

U.S. PATENT DOCUMENTS 3,379,311 A * 4/1968 Kulka ..... 210/97
3,851,491 A * 12/1974 Mason ..... 405/188

* cited by examiner

*Primary Examiner* — Anh Mai
*Assistant Examiner* — Elmito Breval
(74) *Attorney, Agent, or Firm* — McAfee & Taft

(57) ABSTRACT

This invention relates generally to a high volume, buoyancy controlled submersible pump assembly designed to sit on the bottom of a body of water or other liquid substance and move a large volume of water or liquid substance. Alternatively, the submersible pump assembly is capable of achieving and maintaining neutral buoyancy or near neutral buoyancy in a particular body of water or liquid substance. The neutrally buoyant version includes the means to maintain the pump assembly at a given depth without requiring it to sit on the bottom of the body of water or other liquid substance. This invention also relates to linear electrofusion for thermoplastic components.

20 Claims, 14 Drawing Sheets

APPARATUS AND METHOD FOR A SUBMERSIBLE PUMP SYSTEM AND LINEAR ELECTROFUSION

CROSS RELATED APPLICATION

This application claims the benefit of previously filed International Application PCT/US2006/044787 filed Nov. 16, 2006.

BACKGROUND OF THE INVENTION

This invention relates to a submersible pump system and more particularly to buoyancy controlled submersible pump system with a built-in capability for resurfacing for servicing or recovery. The submersible pump system may rest upon the bottom of a lake or other liquid medium or it may float in a suspended or neutrally buoyant position. Further yet, this invention relates to a linear electrofusion method.

Submersible pumps are typically submerged in a body of water such as a lake, stream, river or pond for irrigation or water supply. These submersible pumps have limitations. Some submersible pumps rest directly on the bottom of the body of water where there is a greater chance of ingesting debris. Other pumps rest upon a sled, which has runners in contact with the bottom. Of the sled variety of submersible pumps, some are made of lightweight materials and others are made of metal. In all variations, retrieval and servicing present a problem. Currently available submersible pumps do not have the built-in capacity to be resurfaced for servicing. Rather, they must be physically pulled out of the body of water in which they reside by a cable or other line. Further yet, current systems using multiple pumps with header assemblies typically require accessing all pumps to service a single pump. The only way to service a single pump is to remove the entire header assembly which results in the exposure of all of the pumps.

Current submersible pump systems do not have the capability to either float at various depths or create neutral buoyancy. The ability to have a variable buoyancy submersible pump at various levels is both required and highly desired. For example, a floating submersible pump is desired for obtaining drinking water from a lake. Many people have experienced the taste of the water when a lake "turns over." Lake "turn over" occurs when the surface water of a lake, having higher density than the lower levels, due to temperature or seasonal changes, replaces the lower less dense water. This "turn over" often creates unpleasant tasting. Since current pumping systems are fixed in place, the pump cannot be raised or lowered to optimize intake of the freshest water.

Yet another limitation of existing submersible pumps is the flow volume capacity. Most of the submersible pumps have a flow volume capacity below 2,000 gallons per minute. While land based systems and permanently fixed subsurface systems provide more than 2,000 gallons per minute, these systems cannot be floated or resurfaced for servicing or moving for more preferential water intake.

In one aspect, manufacturing limitations have precluded development of pump assemblies necessary to overcome these problems. For example, the ability to linearly fuse, or weld, two or more thermoplastic components, items or products does not exist. Methods do exist to fuse ends of thermoplastic components, items or products. However, the state of the art has been limited to circumferential electrofusion of thermoplastic pipes. Electrofusion across a linear segment has been limited due to unequal heating and poor distribution of power. To achieve linear connectivity of thermoplastic components, items or products the industry uses spot welding or externally bands the same together.

In order to satisfy the needs of the industry, the current invention provides a buoyancy controlled submersible pump with the built-in capability of being re-floated and having both a simple buoyancy control and variable depth buoyancy. Additionally the present invention enhances serviceability by permitting service of a single pump out of many without having to remove a header assembly. The present invention also provides a submersible pump capable of delivering liquid at a rate of less than 50 gallons per minute up to at least 12,000 gallons per minute. Further, this present invention provides a method for the linear fusing of thermoplastic components, items and products.

SUMMARY OF THE INVENTION

In one preferred embodiment, the present invention provides a submersible pump assembly suitable for operating in a body of liquid such as an ocean, lake, stream, river or pond. The pump assembly comprises at least one ballast tank, a pump housing and/or a structural filter assembly. Typically, the submersible pump assembly comprises one or more main pumps. Alternatively, under low flow requirements, a single main pump is located with the structural filter assembly. The main pump has a first end, or flow inlet, and a second end, or flow outlet. Each pump is disposed within a pump housing or within a structural filter assembly. The pump housing has at least one inlet port on the flow inlet, or first end, of the main pump. Connected to the pump housing and/or the structural filter assembly is at least one ballast tank. In the preferred embodiment for a single pump there are at least two lower ballast tanks and at least one upper ballast tank. Each ballast tank has at least one ballast compartment and usually two ballast compartments. Each of the ballast compartments has at least an upper valve where the upper valve is connected to at least one air source via a compressed air line. In the preferred embodiment, a valve control mechanism is used to open and close the upper valves thereby regulating the air and water flow in or out of the ballast tank. The buoyancy of the entire pump assembly is controlled by manipulating the upper valves.

Additionally, another preferred embodiment of the current invention further provides for remote control of the upper valves on the ballast tank(s). In this embodiment, a power source provides power to the submersible pump assembly to all components needing power. Additionally, each compressed air line preferably incorporates a protective plate. Further, a pressure relief system for the pump assembly and an automatic shutdown system, which is triggered by a low-level, low-flow sensor, is incorporated into this preferred embodiment.

Still further, in another preferred embodiment, the current invention provides a submersible pump assembly comprising a variable buoyancy control system. The variable buoyancy control system comprises the ballast tanks and a second buoyancy device which adjusts the depth and attitude of the pump assembly. The depth and attitude adjustments are preferably manually implemented using devices such as buoys and support cables. Alternatively, the depth and attitude adjustments are automatically controlled by devices such as a depth gauge connected to a controller which regulates air in the ballast tanks to create neutral buoyancy.

The current invention also provides a method of assembling a submersible pump assembly. Assembly of the current invention requires the positioning of the longitudinal components of the pump assembly comprising at least one ballast tank and at least one pump housing or at least one structural filter assembly. Positioning is accomplished by selecting the desired components and physically placing those same desired components next to one another in the desired configuration. One variation of the invention includes two lower ballast tanks and one upper ballast tank. The longitudinal components are secured together. The process is repeated by adding additional longitudinal components until all are secured together. Once secured, the pump is disposed within the pump housing or structural filter assembly and a flow conduit is attached to the output side of the pump. In one of the embodiments of the invention a header is used between the flow conduit and the output side of the pump. In another embodiment the flow of the water from the pump through the conduit is directed under the submersible pump assembly. The configuration of the conduit provides an overall positive vertical angle for the submersible pump assembly. Although the pump will operate without any vertical angle, it is preferred to operate the pump with at least at a minimum positive vertical angle relative to a horizontal plane.

The current invention also provides a method for linear electrofusion of generally linear thermoplastic components. The method comprises positioning the generally linear thermoplastic components. Once selected, the particular electrofusion material is formed from a plate or block into a shape closely matching the juncture created by the contact points between the particular thermoplastic components after those same thermoplastic components are placed in a desired assembled position. The method of the current invention comprises attaching an electrically conducting material to the electrofusion material, inserting the formed material with the attached electrically conducting material into the junctures and attaching electrical leads to the electrically conducting material. Subsequently, an effective voltage and amperage is applied for a period of time sufficient to soften the electrofusion material thereby permitting pressing the material into the juncture. The material is allowed to cool and harden thereby binding the components to one another. This process is repeated for each component until the entire pump assembly is sufficiently fused together to secure the individual thermoplastic materials to one another.

BRIEF DESCRIPTION OF THE DRAWINGS

FIG. 6—Is a side view of FIG. 3.

FIG. 9—Is a cut-away side view of the main pump disposed within pump housing and the affixed structural filter assembly. The flow inlet ports are shown.

FIG. 18—Is a top view of a typical submersible pump removal plan.

DETAILED DESCRIPTION OF THE PREFERRED EMBODIMENTS

Figure 7:
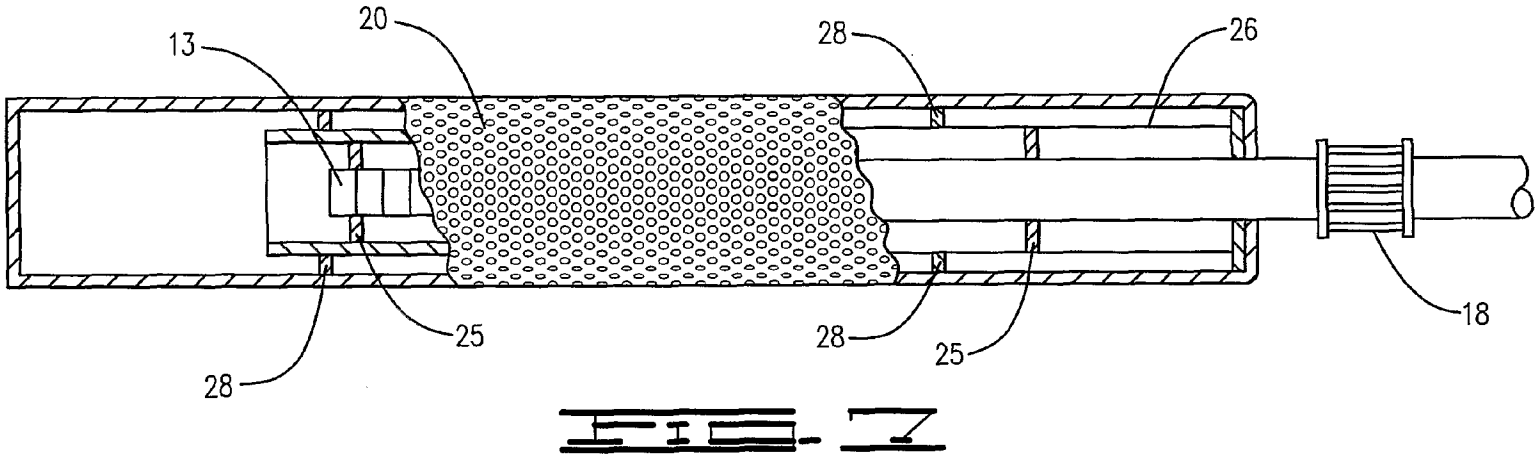
FIG. 7—Is a cut-away side view of the pressure maintenance pump disposed within structural filter assembly.
Figure 8:
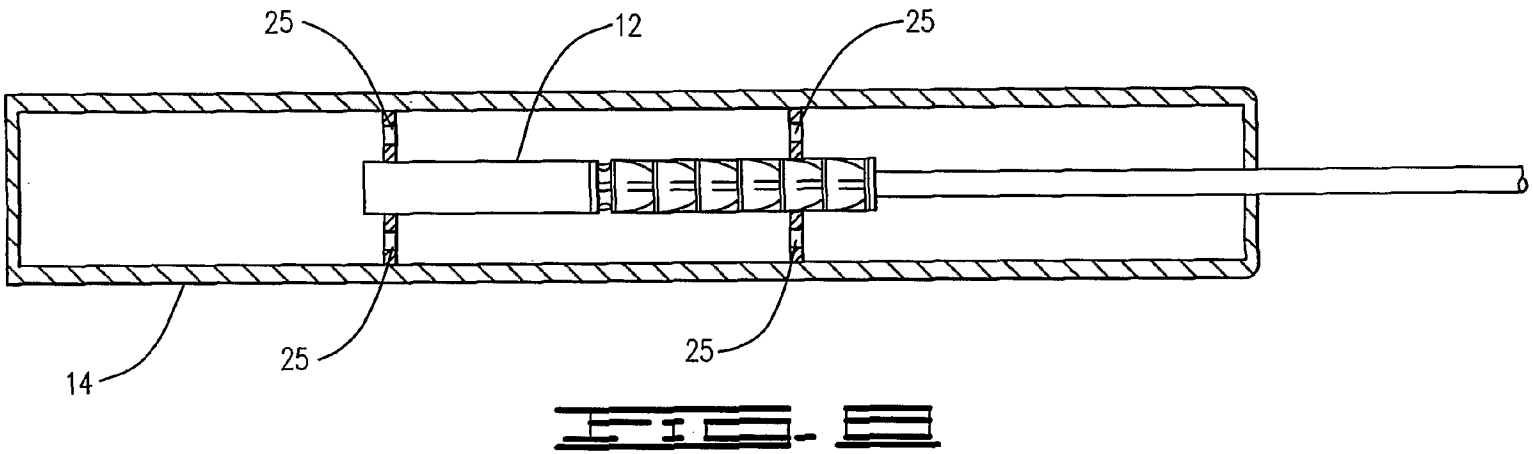
FIG. 8—Is a cut-away side view of the main pump disposed within pump housing.
Figure 3:
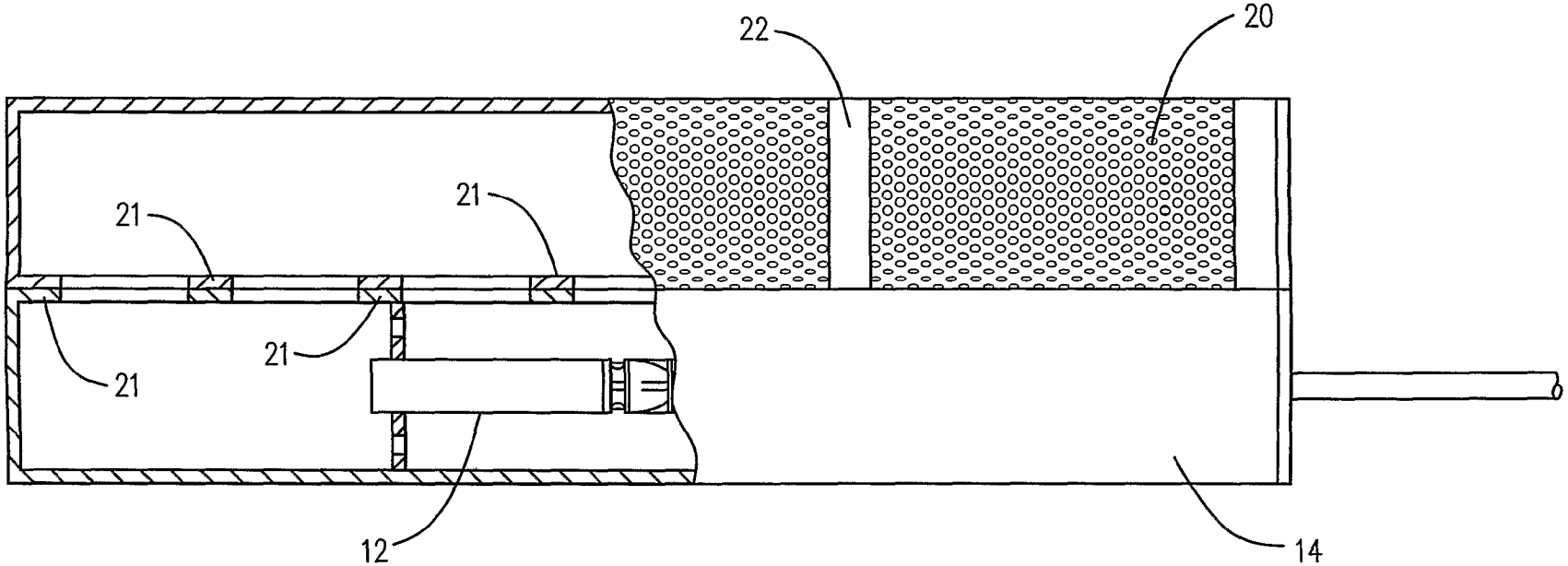
Figure 10:
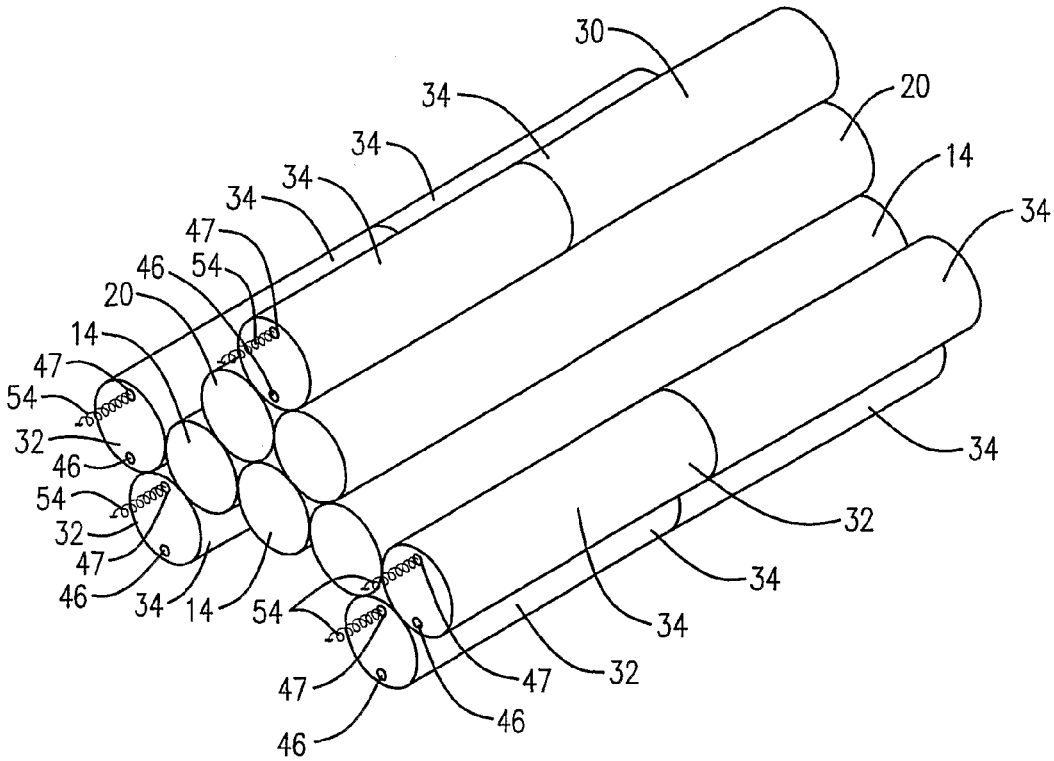
FIG. 10—Is a perspective view of a three pump configuration with two screen filter assemblies, and one upper and four lower ballast tanks, further illustrating the compartments of the ballast tanks and the connectivity of compressed air to each of those compartments.

This invention is a submersible pump assembly 10, an alternate submersible pump assembly 10(*a*), a method for assembling submersible pump assembly 10 or 10(*a*) and a process of linear electrofusion. The submersible pump assembly 10 or 10(*a*) and the method for assembling the same of the current invention will be described with referenced to the drawings where like identification numbers refer to like components in each Figure. FIGS. 1-6 depict some of the alternate embodiments of submersible pump assembly 10 or 10(*a*). FIGS. 7-9 provide additional detail by depicting pump 12 and pressure maintenance pump 13 disposed within pump housing 14 or structural filter assembly 20. FIG. 10 represents a preferred arrangement of the longitudinal components of submersible pump assembly 10 or 10(*a*) when positioned for assembly. FIGS. 17A, 17B and 18 illustrate employment and recovery of submersible pump assembly 10 or 10(*a*). The method of linear electrofusion, the preferred method of assembling submersible pump assembly 10 or 10(*a*) depicted in FIGS. 1-6, 17A, 17B and 18, is depicted in FIGS. 11-16. In FIGS. 11-16, the components used for assembling submersible pump assembly 10 or 10(*a*) are used as an example of how to perform the novel linear electrofusion method.

Figure 1:
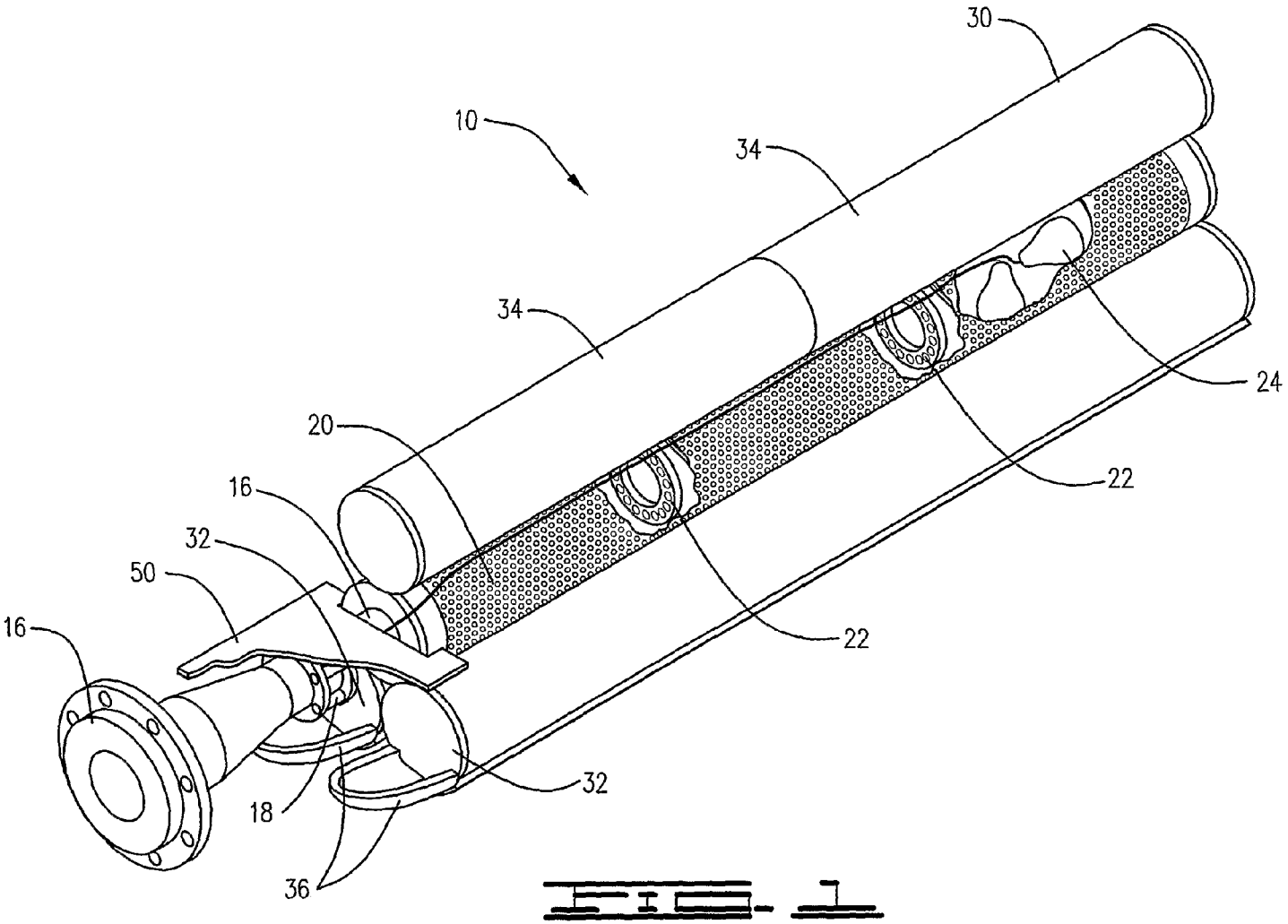
FIG. 1—Is a perspective view of a straight flow single pump configuration with three ballast tanks.

Submersible pump assembly 10 of the present invention is shown in FIG. 1 with submersible pump 12 disposed within the structural filter assembly 20. With continued reference to FIG. 1 and the other drawings, each pump 12 or pressure maintenance pump 13 has a first end for water to enter and a second end for water to exit. In the preferred embodiment, submersible pump assembly 10 includes at least one upper ballast tank 30 and two lower ballast tanks 32. Upper ballast tank 30 includes at least one ballast compartment 34. Flow conduit outlet 16 is attached to structural filter assembly 20 with pump 12 disposed and connected to check valve 18. In the preferred embodiment, a low-level, low-flow automated shutoff switch 24 and support rings 22 are shown in FIG. 1. For protection in the underwater environment, skid plates 36 are affixed to lower ballast tanks 32. Additionally, protective plate 50 protects surface connection lines such as compressed air lines 54, electrical lines, mechanical or digital control lines and/or any other connection between the shore and submersible pump assembly 10 desired for operations, monitoring or maintenance. The power source may be an on-board battery system or, as used in the preferred embodiment, electrical lines connected to a control box on the shore.

Usage of the term "main pump" refers to pump 12. In the preferred embodiments, pump 12 preferably has a horsepower rating between about 5 horsepower and about 100 horsepower. Additionally, in preferred embodiments, pressure maintenance pump 13 typically has a horsepower rating between about 3 horsepower and about 25 horsepower. Such pumps are known to those skilled in the art.

Figure 2:
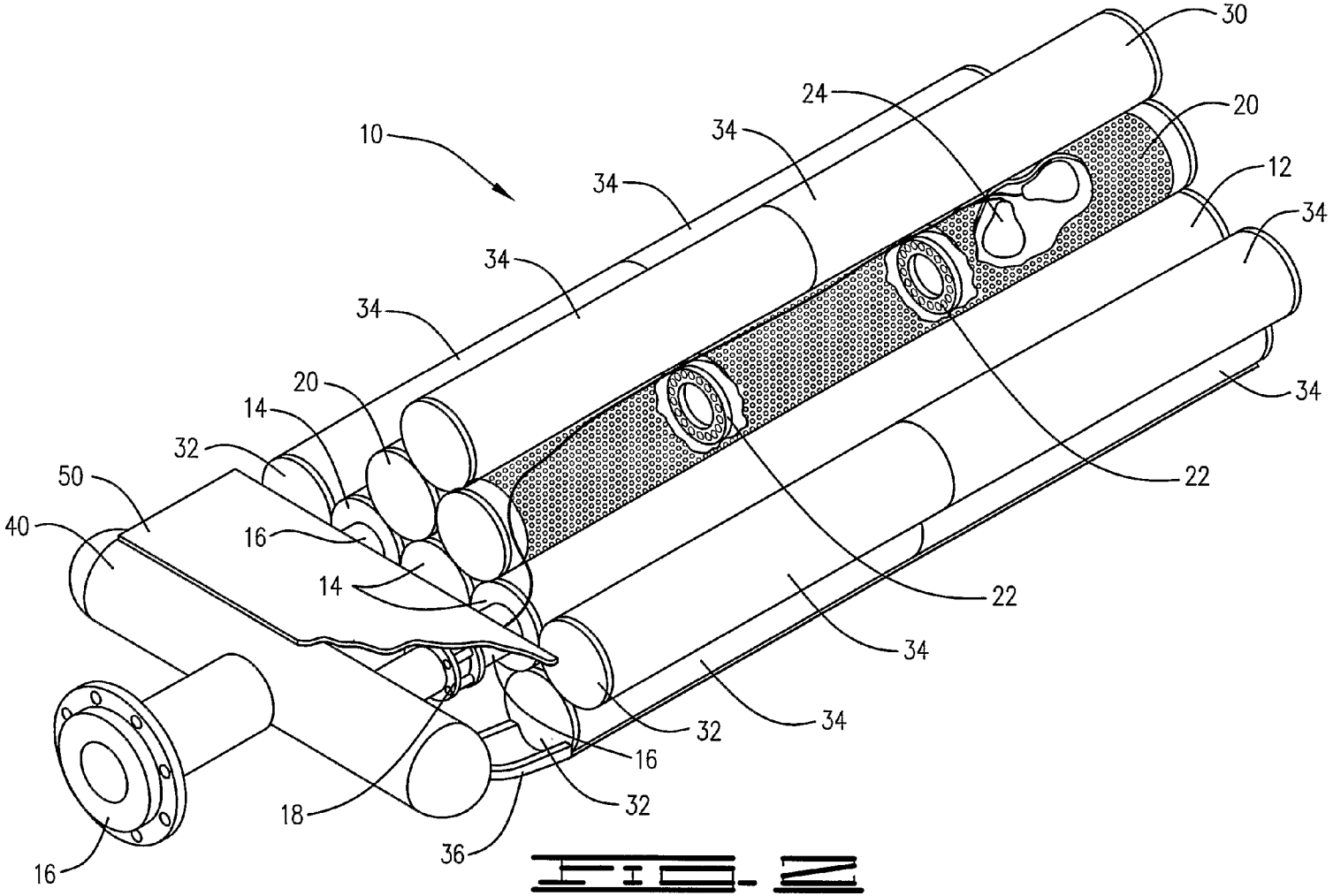
FIG. 2—Is a perspective view of a straight flow three pump configuration with a header, two screen filter assemblies, one upper and four lower ballast tanks.

An alternative configuration of submersible pump assembly 10 is shown in FIG. 2, where pump 12 is disposed within pump housing 14 and is in fluid communication with structural filter assembly 20. In the embodiment of FIG. 2, submersible pump assembly 10 comprises two structural filter assemblies 20, a single upper ballast tank 30 and four lower ballast tanks 32. Further, three pumps 12 are disposed within individual pump housings 14. Each pump 12 has a check valve 18 for controlling fluid communication between pump 12 and header 40. Directing flow away from header 40 is flow conduit outlet 16. Each lower ballast tank 32 has at least one ballast tank compartment 34. In this embodiment each ballast tank 32 is shown with two ballast tank compartments 34. Also shown in FIG. 2 is low-level, low-flow automated shutoff switch 24 and support rings 22 disposed within structural filter assembly 20. Protective plate 50 is shown in position to protect surface connection lines such as compressed air lines 54 (not shown in FIG. 2) or electrical lines 52 (not shown).

In FIG. 1 pump 12 is disposed within structural filter assembly 20. Alternatively, pump 12 may be positioned within pump housing 14 as shown in FIGS. 2, 3, 8 and 9. Thus, pump 12 may be located in either structural filter assembly 20 or pump housing 14 as may be dictated by the local conditions. The local conditions are determined by the desired volume of water to be pumped. For example, the single pump configuration depicted in FIG. 1 provides pump 12 disposed in structural filter assembly 20. Another example is the triple pump configuration depicted in FIG. 2 which has pumps 12 disposed in pump housing 14 and structural filter assembly 20 in fluid communication with pump housing 14.

In another embodiment, pressure maintenance pump 13, depicted in FIG. 7, may be substituted for pump 12 and is typically disposed in structural filter assembly 20, as shown in FIG. 8. Pump spacer 25 is used to hold pump shroud 26 in structural filter assembly 20. Pump shroud 26 is also referred to as a pump sleeve. Pressure maintenance pump 13 may be used for operations where a constant flow of 50 gallons per minute or less is required. Both pressure maintenance pump 13 and pump 12 may operate together. In one embodiment, pump 12 is disposed within pump housing 14 and pressure maintenance pump is disposed within structural filter assembly 20. In this embodiment, both pressure maintenance pump 13 and pump 12 are in fluid communication with header 40.

For submersible pump assembly 10 to operate, water must be able to freely communicate with pump 12. As seen in FIG. 9, to facilitate fluid communication with pump 12 structural filter assembly 20 is in fluid communication with pump housing 14 which in turn is in fluid communication with pump 12. In a preferred embodiment, pump housing 14 has filtered inlets 21 used in conjunction with structural filter assembly 20. Filtered inlets 21 may be used without structural filter assembly 20. In the preferred embodiment the orientation of pump 12 is critical for proper, filtered fluid communication. Thus the first end of structural filter assembly 20 corresponds to the first end of pump housing 14 which corresponds with the first end of pump 12. The first end of pump 12 includes a water inlet port. The second end of pump 12 includes a water outlet port.

Each upper ballast tank 30 and lower ballast tank 32 has valve 47 to allow air or suitable gas to displace water and provide buoyancy. In the preferred embodiment upper valve 47 is used on each ballast tank compartment 34. Opening upper valve 47 and releasing the air or suitable gas allows water to enter through a lower opening. In the preferred embodiment the lower opening may be lower valve 46 or it may be an opening located on a lower portion of the tank. If lower valve 46 is used, it must be opened to allow water to enter each ballast tank compartment 34 when the air or suitable gas is released through upper valve 47. Buoyancy of submersible pump assembly 10 or 10(*a*) is controlled by opening upper valve 47 thereby regulating the volume of air or suitable gas within ballast tank compartment 34. In the preferred embodiment, a compressed air line is connected to the valve and remotely controlled. Further, each of the valves may be individually operable from the surface.

It is known to those skilled in the art how to float and sink ballast tanks. In the preferred embodiment only one upper valve 47 per ballast compartment 34 is used to communicate air or other suitable gas to ballast compartment 34. However, any number of valves may be used. Further, independent of the number of valves used to communicate air to ballast compartment 34, there must be at least one separate opening or lower valve 46 to allow water to flow in and out of each ballast compartment 34. In the preferred embodiment, instead of using lower valve 46, an opening (not shown) is located on the bottom of ballast tanks 30 and 32. Further, in the preferred embodiment, when lower valve 46 is not used there is an opening for each ballast compartment 34. Control of the ballast compartment 34 upper valve 47 and lower valve 46 by an on-board control mechanism (not shown), by a surface control system with connective lines or by a combination of both.

In the preferred embodiment, to actuate descent of the submersible pump assembly 10 or 10(*a*), the upper ballast tank 30 is kept full of air while the lower ballast tanks 32 take on water. This function provides for a balanced decent of the submersible pump assembly 10 or 10(*a*). Once the submersible pump assembly 10 or 10(*a*) is in position most of the air in upper ballast tank 30 is released. To float the submersible pump assembly 10 or 10(*a*) the reverse action is taken. Upper ballast tank 30 is filled with air first and then lower ballast tanks 32 are filled with air.

In the preferred embodiment structural filter assembly 20 is tubular in shape. Filter screens form the majority of structural filter assembly 20 and support rings 22 are placed to structurally support it. In the preferred embodiment, pump housing 14, upper ballast tank 30 and lower ballast tanks 32 are all tubular in shape. It is understood for all of the aforementioned components that shape is limited only by pump 12 and/or the ability to fabricate the submersible pump assembly 10. Thus, other structural configurations will perform satisfactorily in the current invention.

It is also known to those skilled in the art that when more pump housings 14 are used that more ballast is required. In such situations, additional ballast may be provided by the addition of ballast tanks 30 and 32 or use larger ballast tanks 30 and 32 will be required. At least one top ballast tank 30 is preferred to provide stability while the entire submersible pump assembly 10 or 10(*a*) descends or ascends in a body of liquid.

During operation of submersible pump assembly 10 or 10(*a*) there will be times where the water flow is too slow or the water level is too low for safe operations. In those instances low-level, low-flow automated shutoff switch 24, shown in FIGS. 1-3, stops pump 12 or pressure maintenance pump 13. In the preferred embodiment, low-level, low-flow automated shutoff switch 24 is located in the first end of structural filter assembly 20. If during operations internal water pressure exceeds a safe level, pressure relief valve 82, depicted in FIGS. 17A and 17B, provides the ability to reduce internal pressure. A safe level of water pressure is based upon the pressure limitations of surface flow conduit 17 and all other components communicating the water.

Figure 3:
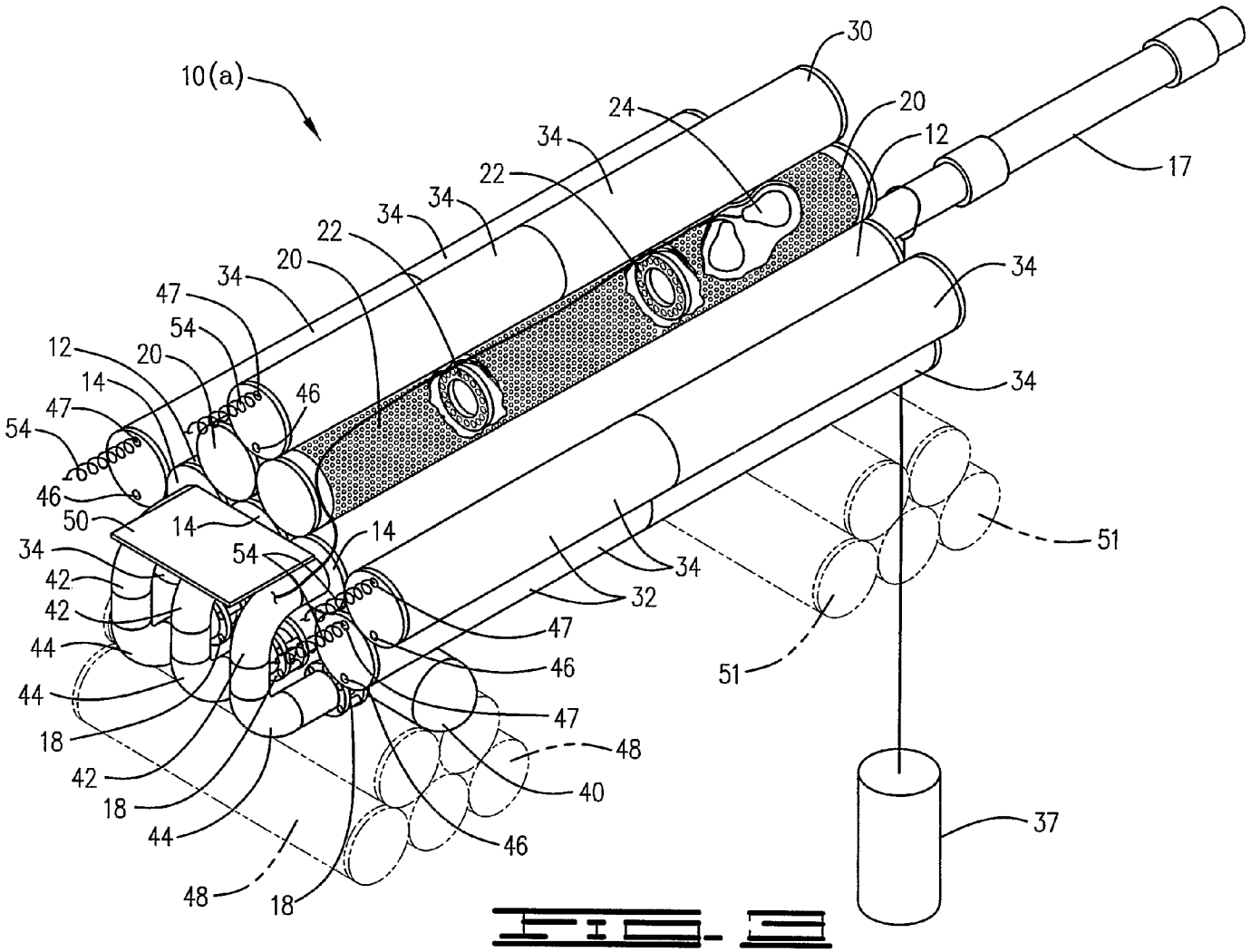
FIG. 3—Is a perspective view of a reverse direction flow pump assembly having a header ballast tank, a support ballast tank, an anchor and using a three pump configuration with a header, two screen filter assemblies, one upper and four lower ballast tanks.

FIGS. 3-6 show a preferred embodiment where surface flow conduit 17 carrying water passes under the submersible pump assembly 10(*a*). The operations are the same as when the water flows straight from pump 12 or pressure pump 13 into flow conduit outlet 16. The configuration of surface flow conduit 17, shown in FIGS. 3 and 6 provides an overall positive vertical angle for submersible pump assembly 10(*a*). Although pump 12 will operate without any vertical angle, it is preferred to operate pump 12 with at least at a minimum positive 0.5 degrees vertical angle relative to a horizontal plane. The configuration of submersible pump assembly 10(*a*) shown in FIG. 3 provides a pump 12 angle greater than 0.5 degrees vertical angle relative to a horizontal plane.

Support for submersible pump assembly 10(*a*) is desired for optimum performance of the invention. In addition to the configuration of surface flow conduit 17 in FIGS. 3-6, a preferred embodiment for supporting submersible pump assembly 10(*a*) is comprised of header ballast tanks 48 with leg(s) 49 and support ballast tanks 51. In this preferred embodiment, header ballast tanks 48 with leg 49 and support ballast tanks 51 provide the primary support for submersible pump assembly 10(*a*). As depicted, these components provide the preferred positive angle for submersible pump assembly 10(*a*). Although the preferred embodiment uses the combination of described elements to support submersible pump assembly 10(*a*), leg(s) 49 are sufficient to provide the desired configuration. Leg(s) 49 are defined as anything suitable for supporting submersible pump assembly 10 or 10(*a*) that is not a header ballast tank 48, support ballast tank 51 or a surface flow conduit 17.

In an alternative preferred embodiment, the preferred minimum angle shown in FIGS. 3 and 6 may also be accomplished by using a first conduit elbow 42 and second conduit elbow 44 connected with a pipe coupling 43 without header ballast tanks 48, leg(s) 49 or support ballast tanks 51. In this alternative embodiment, support for submersible pump assembly 10(*a*) is provided by lower ballast tanks 32. In this alternative preferred embodiment, second conduit elbow 44 is in communication with header 40 which is located under the output port (not shown) of pump 12. Fluid is communicated from header 40 to the surface via surface flow conduit 17. Surface flow conduit 17 is a combination of several pieces of conduit providing fluid communication from submersible pump assembly 10(*a*) to the surface. In this alternative preferred embodiment, multiple surface flow conduits 17 segments are used; however, a single integrated surface flow conduit 17 will also perform satisfactorily.

Figure 4:
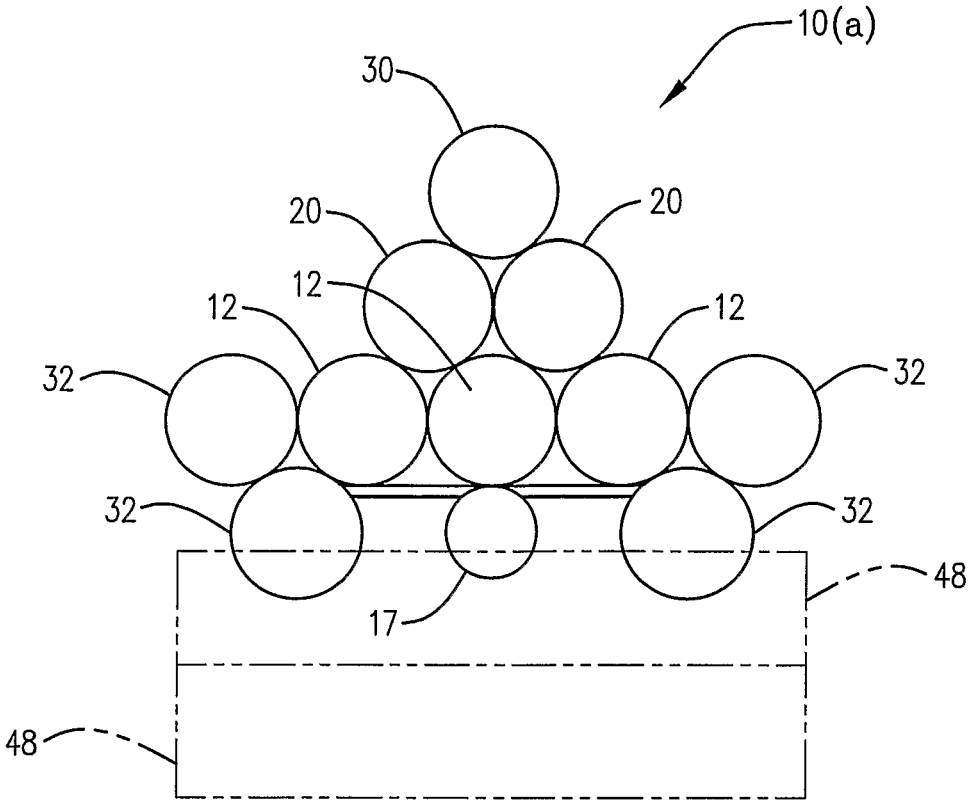
FIG. 4—Is a back view of FIG. 3.
Figure 5:
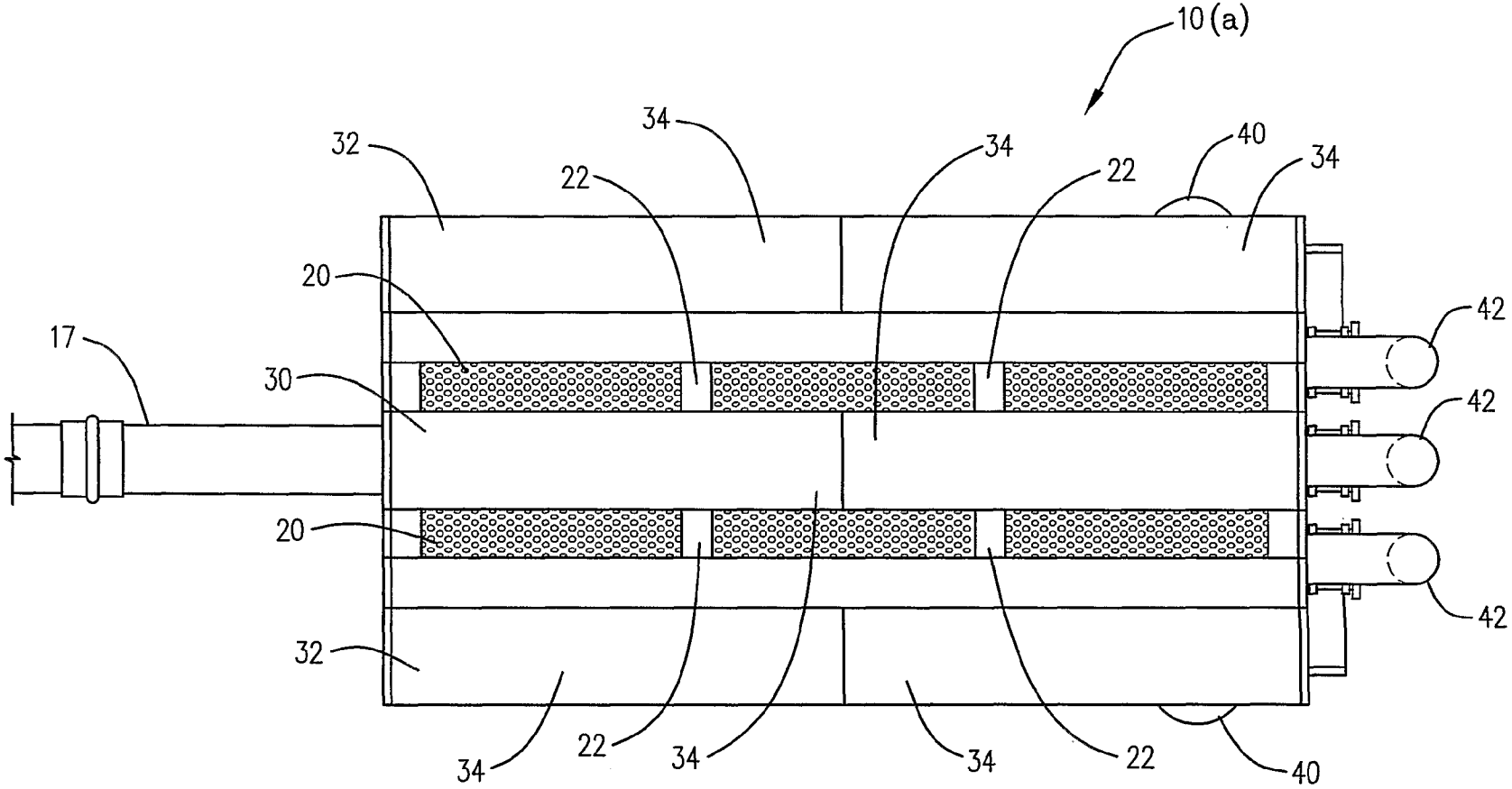
FIG. 5—Is a top view of FIG. 3.
Figure 3:
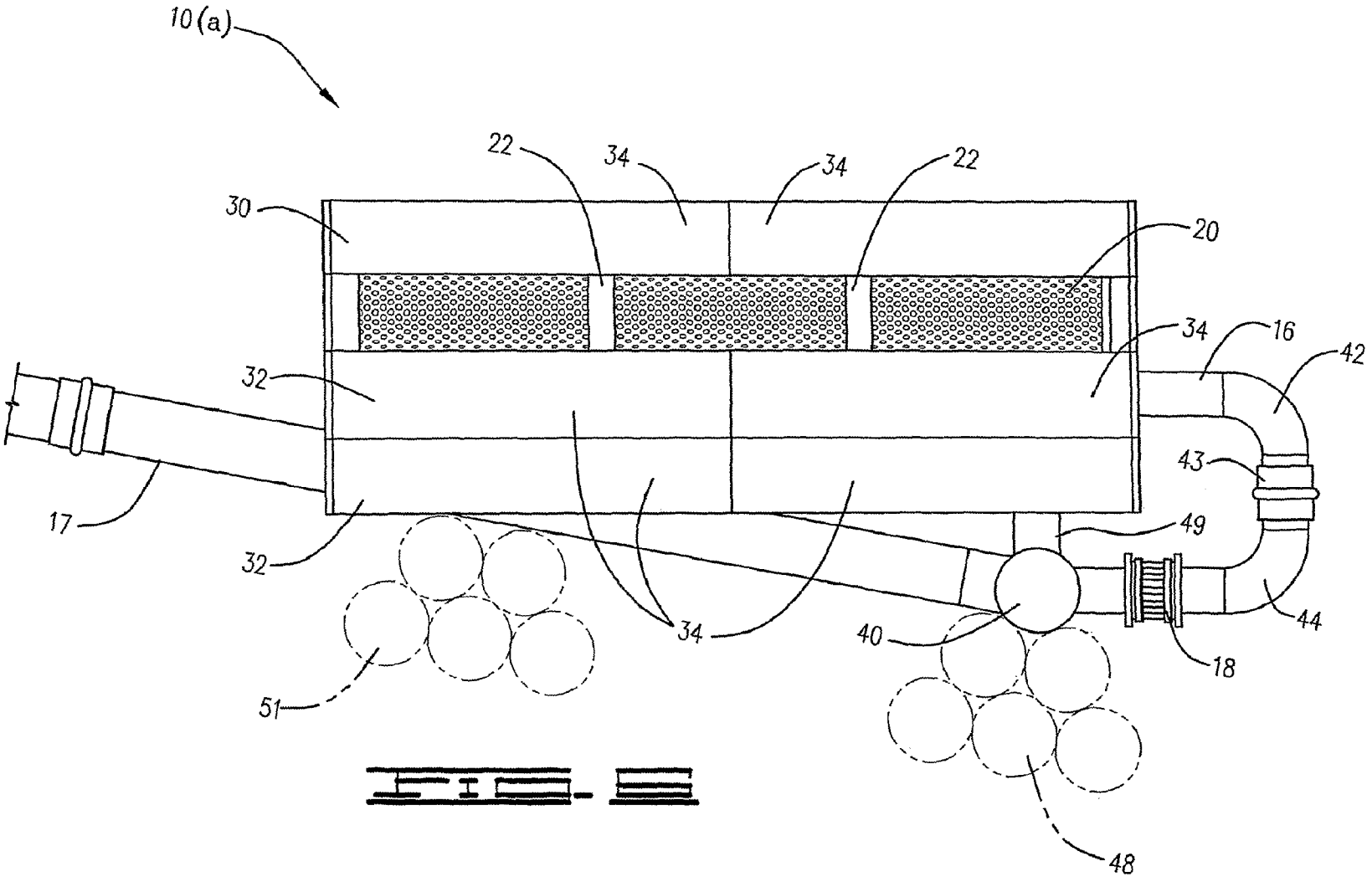

To further clarify the component positioning in the preferred embodiment of submersible pump assembly 10(*a*), FIG. 4 depicts a reverse view of the layout of the major components of submersible pump assembly 10(*a*). FIG. 4 clearly depicts upper ballast tank 30, lower ballast tanks 32 and pump 12 within pump housing 14. Further, surface flow conduit 17 is shown along the lower centerline of submersible pump assembly 10(*a*). FIG. 5 shows a top view of submersible pump assembly 10(*a*) further detailing the layout of upper ballast tank 30, lower ballast tanks 32, structural filter assemblies 20, pump housing 14, first conduit elbow 42 connected to pump housing 14 and surface flow conduit 17 is shown along the lower centerline. Also shown are upper ballast tank 30 and lower ballast tanks 32 ballast compartments 34. FIG. 3 shows compressed air line 54 connected to upper ballast tank 30 and lower ballast tanks 32 at an upper valve (not shown).

The current invention also provides a submersible pump assembly 10 or 10(*a*) having controlled buoyancy which permits submersion without contacting the floor of the body of water. As depicted in FIGS. 3 and 6, anchor 37 allows the positioning of submersible pump assembly 10 or 10(*a*) in a preferred position for operations. In this embodiment, submersible pump assembly 10 or 10(*a*) may be suspended in the water using a buoy system (not shown) or it may use an automated, variable buoyancy system (not shown) which continuously controls the volume of air in ballast tanks 30 and 32.

In the automated, variable buoyancy system a separate or second valve control mechanism (not shown) is used to maintain neutral buoyancy by adding air or releasing air. The second valve control mechanism (not shown) may also be operated remotely by an on-board system, by a cable connected to the shore or by a combination of the two. The second valve control mechanism (not shown) uses a depth gauge and a control system to add or remove air to each ballast compartment 34 as necessary to maintain a constant depth and a constant attitude. Such depth gauges and control systems are know to those skilled in the relevant art.

Submersible pump assembly 10(*a*) depicted in FIGS. 3 and 6 provides the ability to easily maintain pumps 12. In particular this embodiment permits removal of a single pump 12 from pump housing 14 without disconnecting the remaining pumps 12 disposed within their pump housings 14. In the embodiment of FIGS. 3 and 6, removal and service of pumps 12 requires only removal of pipe coupling 43. First conduit elbow 42 stays attached to pump housing 12 during removal. Second conduit elbow 44, check valve 18 and header 40 remain assembled. In this embodiment, this removal is referred to as "easy access removal" and is further described below. Following removal of these components, pump 12 or other components located within pump housing 14 or structural filter assembly 20 are accessible for service. Thus, a single pump 12 or other component may be removed from within pump housing 14 or structural filter assembly 20 without disconnecting header 40. The same set up may also be achieved by a single conduit or a larger number of conduits and couplings.

The "easy access removal" of pump 12 or pressure maintenance pump 13 requires removing pipe coupling 43. Alternative, a single flow conduit (not shown) providing a connection between check valve 18 and header 40 may be used instead of first elbow 42, pipe joint 43 and second elbow 44. In this configuration, "easy access removal" of pump 12 or pressure maintenance pump 13 requires disconnecting a single flow conduit (not shown) at check valve 18. Additionally, instead of an alternate single flow conduit, a plurality of elbows and pipe coupling 43 may be used. It is know to those skilled in the relevant art how to connect two components to make a bend in the pipe or conduit. The preferred assembly to implement the "easy access removal process" uses two mating flanges (not shown) at check valve 18 and header 40. Such mating flanges are known to those skilled in the art. In the preferred embodiment stainless steel is the material of choice to mate the connections with check valve 18 and header 40.

Pump 12 may be replaced with pressure maintenance pump 13 which may be disposed within either pump housing 14 or structural filter assembly 20. Pressure maintenance pump 13 is used when flow rates are desired to be kept constant and are 50 gallons per minute or less. A pressure maintenance pump 13 will normally be used in irrigation operations. The maximum flow rate of submersible pump assembly 10 or 10(*a*) is limited by header 40, flow conduit 17 size, the number of pumps 12 and/or pressure maintenance pumps 13 and structural filter assemblies 20. For example, when irrigation requires a flow rate of more than 12,000 gallons per minute, submersible pump assembly 10 or 10(*a*) preferably comprises four pumps 12 and two header ballast tanks 30. Submersible pump assembly 10 or 10(*a*) provides flow rate capacities ranging from a minimal flow of less than one gallon per minute to more than 12,000 gallons per minute.

Although all of the embodiments referenced herein use air to create buoyancy, any gas capable of creating buoyancy may be used in this invention. The term "water" as used in this invention is meant to include other liquids capable of being pumped. For this invention the term "filter" refers to any device suitable for preventing debris and contaminates from entering pump 12 and/or pressure maintenance pump 13. Suitable filters include metal or fabric filters, screens, mesh or any other similar material or device.

With continued reference to the figures, the use of submersible pump assembly 10 will be described with regard to placing submersible pump assembly 10 in a body of water. A side view depicting the operation of submersible pump assembly 10 in a lake is shown in FIGS. 17A and 17B. In FIGS. 17A and 17B submersible pump assembly 10 may be replaced by submersible pump assembly 10(*a*) to demonstrate the same operation. In FIGS. 17A and 17B submersible pump assembly 10 is shown in two positions. In the first position shown in FIG. 17A, submersible pump assembly 10 is floating on the surface of the water. The shallowest depth of operations of submersible pump assembly 10 is where the structural filter assembly 20 and pumps 12 are below the surface of water 72. Typically when placed in a lake, submersible pump assembly 10 is horizontally positioned in excess of 100 feet from the shore and approximately three feet or more below the surface of water 72. Surface flow conduit 17 extends from submersible pump assembly 10 to pump control console 80. In the second position shown in FIG. 17B, submersible pump assembly 10 is resting on the bottom of a lake or other body of water 72. Because of the irregularities often encountered on the bottom of a lake or other body of water 72, surface flow conduit 17 is preferably semi-flexible in nature or has articulating and/or movable joints. In this representative embodiment, pressure relief valve 82, flow meter 86 and ball valve 84 are all located at pump control console 80. Pump control console 80 rests upon pump control console base 88. Distribution flow conduit 85 flows away from pump control console 80 into distribution fluid lines (not shown). In the representative embodiment, operations are controlled and run from pump control console 80. There are several possible variations of the representative embodiment including placement of pump control console 80 away from pressure relief valve 82, flow meter 86 and ball valve 84.

The ability to re-float submersible pump assembly 10 for removal and/or servicing is shown in FIG. 18. The process of floating or re-floating submersible pump assembly 10 is the reverse of the process used to sink submersible pump assembly 10. Re-floating may also be accomplished by using a lifting mechanism and lifting points (not shown). After re-floating, submersible pump assembly 10 is pulled mechanically or manually by mooring lines 74 to the shore for removal and/or servicing. Alternatively, removal and/or servicing of submersible pump assembly 10 may also be executed by using a boat, barge or other similar floating device and servicing pump assembly 10 on the body of water 72. For example, a floating dock may be used to surround submersible pump assembly 10 and allow for surface flow conduit 17 to be disconnected. Then submersible pump assembly 10 can be moved to the shore for removal and/or servicing.

The current invention also provides a novel method for assembling pump assembly 10. As an initial step, the current invention positions the longitudinal components such, as pump housing 14, structural filter assembly 20, upper ballast tank 30 and lower ballast tanks 32, in the preferred orientation relative to each other as depicted in FIG. 10. In one preferred embodiment all longitudinal components are secured together without any incremental steps. In another preferred embodiment the longitudinal components are incrementally secured together. It is understood by those skilled in the art that securing includes placing metal bands, wire, rope, nylon straps and metal straps about the exterior of the components to be secured. In the preferred embodiment, following securing by straps or other devices the components are further secured to one another by welding, gluing, bonding and other similar permanent or semi-permanent means. To facilitate securing of the longitudinal components, they are preferably assembled in smaller groupings capable of retaining the desired shape once secured. The longitudinal components are added until the final submersible pump assembly 10 is completed.

By way of example for a single pump 12 disposed in pump housing 14, pump housing 14 is secured to two structural filter assemblies 20. Next the lower ballast tanks 32 are secured to the first secured longitudinal components on either side and slightly below. The upper ballast tank 30 is secured to the entire grouping above the two structural filter assemblies 20. In the preferred assembly method a combination of wire or straps initially retaining the longitudinal components in place. The longitudinal components are subsequently joined to one another by an improved linear electrofusion process described below.

Once the major longitudinal components of submersible pump assembly 10 are secured, the remainder of submersible pump assembly 10 is assembled. Pump 12 or pressure maintenance pump 13 is disposed in the desired longitudinal component. Next flow conduit outlet 16 is connected to either to either pump housing 14 or structural filter assembly 20 and to check valve 18. Next flow check valve 18 is connected to header 40. Alternatively, flow conduit 16 is first connected to first elbow 42, pipe coupling 43 and second elbow 44 before connecting to check valve 18. The remainder of the flow conduit 17 is attached to the surface and run to pump control console 80. To impart a vertical angle, header 40 and/or leg(s) 49 are used. Ballast tanks 48 and ballast tanks 51 may also be used for total vertical lift. Header ballast tanks 48 with leg 49 and support ballast tanks 51 may be secured to submersible pump assembly 10 by any of the aforementioned methods. An optional skid plate 36 may be affixed to any of the lower ballast tanks 32, header ballast tanks 48 and support ballast tanks 51. Skid plate 36 is affixed by using mechanical devices or securing with a bonding method described herein.

The current invention also provides a linear electrofusion process suitable for securing thermoplastic materials to each other. For example, pump housing 14 and ballast tanks 32 described in the submersible pump assembly disclosure, are preferably secured to each other using linear electrofusion.

The steps involve selecting and positioning at least two generally linear thermoplastic components 70 and determining the shape of the juncture formed between thermoplastic components 70. Forming electrofusion material 60 to match the juncture and affixing or embedding it with electrical conducting material 66 or 67. Next electrofusion material 60 is inserted and secured into the juncture. After electrofusion material 60 is secured, electrical connections 68 are attached to the affixed or embedded electrical conducting material 66 or 67 at electrical leads 76. Subsequently, an electrical current is applied for an effective period of time with an effective voltage and effective amperage until electrofusion material 60 enters a semi-molten state. Electrical connections 68 are removed. The semi-molten electrofusion material 60 is pressed into the juncture where an intermingling of the polymers occurs. The now fused electrofusion material 60 and thermoplastic components 70 are allowed to cool and solidify as integrated components. The process is repeated for each thermoplastic component needing linear electrofusion.

In a preferred embodiment, at least two generally linear thermoplastic components 70 are positioned adjacent to one another in a desired configuration. The linear juncture formed by the at least two thermoplastic components 70 is the area to be fused using this linear electrofusion process. As used herein, a generally linear thermoplastic component 70 to be fused to one another include, but are not limited to, pipes, tubes, flat pieces and panels, curved pieces and panels and other structures wherein the resulting fused juncture between the components is not a circumferential join. By way of example, a circumferential joint exists between two abutting pipes or between two pipes forming an annular joint.

Thermoplastic components 70 preferably have a standard dimension ratio between about 7.0 to about 32.5. The thermoplastic material of the thermoplastic component 70 and electrofusion material 60 is a high molecular weight polymer. The preferred thermoplastic materials are high density polyethylene (HDPE), polypropylene (PP), Polybutylene Terephthalate (PBT), Polycarbonate (PC), Polyethylene (PE), Polyethylene Terephthalate (PET), Polyvinyl Chloride (PVC), Polyketone (PK), Polyetheretherketon (PEEK) and Polyphthalamide (PPA). However, this method should operate satisfactorily with all thermoplastics.

Electrofusion material 60 is formed from a thermoplastic material selected to match or at least be compatible with the specific material of thermoplastic component 70. A linear segment of electrofusion material 60 is shaped to match the juncture between the generally linear thermoplastic components 70 to be fused. Electrofusion material 60 is usually formed from a plate or block of electrofusion material 60 of the same likeness as the thermoplastic components 70. Electrofusion material 60 may also be formed from or molded from pellet or powder thermoplastic material. A geometrically shaped mold of the aforementioned juncture is constructed and molten electrofusion material 60 is poured into the mold. The particular geometric shape of the mold is dependent upon the juncture formed by thermoplastic components 70. Regardless of the geometric shape of the formed electrofusion material 60 or the molded formed electrofusion material 60, the preferred design maximizes surface contact between electrofusion material 60 and thermoplastic components 70 once electrofusion material 60 is inserted into the juncture.

Once electrofusion material 60 is formed, electrical conducting material 66 or 67 is affixed to electrofusion material 60 with exposed leads 76 accessible external to electrofusion material 60. Alternatively, electrical conducting material 66 or 67 is placed in the mold prior to pouring the molten electrofusion material 60 into it. Once electrically conducting material 66 or 67 is placed in the mold, in the preferred configuration, the molten electrofusion material 60 is poured around it and allowed to harden, thereby forming electrofusion material 60. A tape-like or ribbon material with electrical conducting material 66 or 67 attached may also be electrofusion material 60.

Electrical conducting material 66 or 67 is any electrically conducting material 66 or 67 capable of achieving the amperage, voltage and temperature requirements discussed hereinafter. In a preferred embodiment 14 gauge solid copper wire is used. The gauge of the wire is dependent upon the length of the linear electrofusion to be accomplished. For example, the wire may be between a 2 and a 22 gauge wire. The appropriate gauge of the wire is determined by the voltage input, the amperage input and the length of wire to be used. The calculations are common engineering calculations. However, additional considerations for determining the gauge of the wire are the voltage and amperage used for the linear electrofusion and is discussed below.

Figure 13:
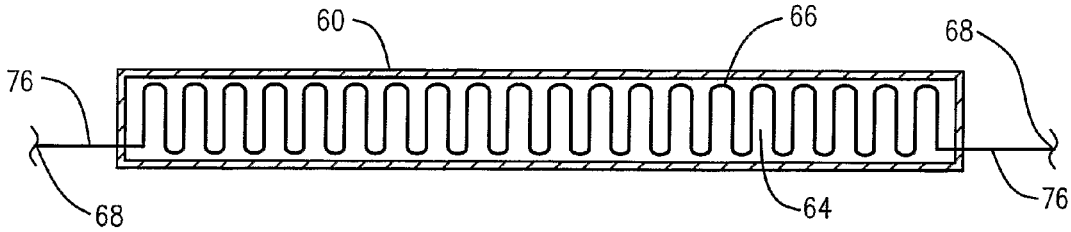
FIG. 13—Is a side view of the formed electrofusion material with a formed electrical element affixed to one side.
Figure 14:
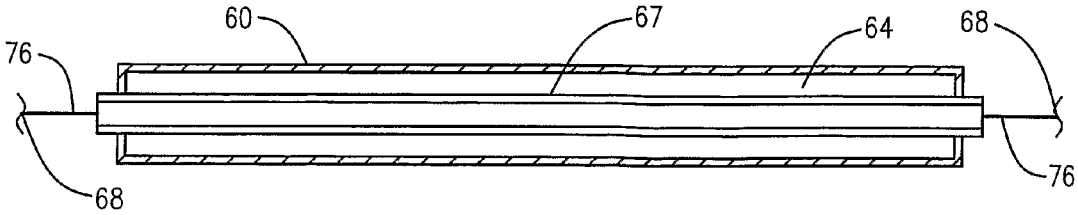
FIG. 14—Is a side view of the formed electrofusion material with a straight electrical element affixed to one side.

One of two alternate configurations of wire may be used in the preferred embodiment. One form is an alternating wave form 66. The other is a straight, tautly pulled wire form 67. To form the alternating waves, the wire is wound through two gears where it undergoes a rotary meshing into a form of alternating waves. As seen in FIG. 13, formed alternating waves 66 preferably have a gap one-quarter of the area to be covered and a height of three-quarters of the area to be covered. In the straight, tautly pulled wire form 67 the separation between the wires is one-quarter of the area to be covered with a similar separation from the edge.

The linear electrofusion process of the current invention requires a preferably constant heat transfer along the entire length of thermoplastic components 70 to be fused. Preferably the heat transfer rate is in the range of about 25 degrees Fahrenheit to about 30 degrees Fahrenheit rise in base material temperature per minute. Rapid heating of electrofusion material 60 and thermoplastic components 70 is not desired. Therefore, it is necessary to determine the variable parameters to achieve a desired heat level of electrofusion material 60 and thermoplastic components 70. Since the type and the length of thermoplastic components 70 are known, the effective temperature necessary to achieve the desired semi-molten state is known and is based upon specification of thermoplastic components 70. Further, the effective temperature is impacted by environment temperature conditions and must be adjusted accordingly. However, based upon testing, it is preferred to bring the thermoplastic material to an ambient temperature for a standard day or more. Specifically, the thermoplastic material should be maintained between 59 degree Fahrenheit and 77 degree Fahrenheit with an atmospheric relative humidity between about 30% and 60%.

The unknown parameters are the type and size of the wire, the amount of voltage and amperage and the time period over which the voltage and amperage must be applied to achieve the effective temperature for linear electrofusion of electrofusion material 60 and thermoplastic components 70. Testing was used to determine the unknown parameters in the balancing of time, voltage, amperage and wire.

Test results revealed the following parameters and processes for determining the unknown parameters of balancing of time, voltage, amperage and wire. For the test results that follow, the standard dimension ratios of the thermoplastic materials used were 17.0 and 32.5. First to be determined is the temperature where the linear electrofusion process is to be conducted. In cold conditions, it is preferred to either warm up the thermoplastic material slowly or to use a longer period of time to conduct electrofusion. For the following tests ambient temperature, as defined above, was used.

Thermal energy input by the electrically conducting material 66 or 67 of the electrofusion process is determined by the individual thermoplastic material selected and the melting temperature of the same. The melting point specifications for electrofusion material 60 and thermoplastic components 70 are available from the manufacturer and provide the heat transfer rate inherent in the thermoplastic material. Using the melting point information, the amount of thermal energy required to sufficiently melt the material is easily calculated. The amount of thermal energy, or power, in a wire is calculated by knowing the resistance of the wire and current input to the wire. The equation is $P=VI$ where P is power (watts), V is voltage and I is the current input (amperage). Resistance is defined as $R=V/I$. For a wire of a given length, the equation for resistance is $R=(rL)/A$ where r is the electrical resistivity (microohm-unit of length) of the wire, L is the length of the wire (unit of length) and A is the cross-sectional area (unit of length$^2$) of the wire. Most tables are in centimeters and conversions to English units may be done. Based upon the available voltage and amperage to produce a given power, the resistance of the wire is known. Thus it is possible to determine the wire gauge for a given linear electrofusion project based upon the desired thermal energy necessary to initiate melting thermoplastic components 70 and electrofusion material 60. Based upon testing, the preferred wire to use was a 14 gauge solid copper wire.

Based upon testing, as thermal energy is applied to electrofusion material 60 and thermoplastic components 70 it should be monitored to ensure the surface temperature does not exceed 195 degree Fahrenheit. A slow rate of heating is preferred to achieve and maintain, a uniform temperature throughout electrofusion material 60 and the surface contact area of thermoplastic components 70 during the process. Test results show that the time period for linear electrofusion of electrofusion material 60 and thermoplastic components 70 in an ambient temperature is between about 13 to about 15 minutes. However, test results show that time is decreased or increased when the ambient temperature is higher or lower respectively. To ensure even heat transfer, it is preferred that the surface temperature of electrofusion material 60 is monitored and, preferably, the surface temperature uniformly reaches the range of 180 degree Fahrenheit and 195 degree Fahrenheit. Additionally, an infrared camera is used as one method to monitor and to ensure that the surface temperature does not exceed 195 degree Fahrenheit for any gaps between electrofusion material 60 and thermoplastic components 70.

Testing results for a HDPE thermoplastic component 70 of about 10.0 to about 12.0 feet where a similar HDPE electrofusion material 60 was used produce the following results. In this test, electrofusion material 60 was a triangle with a peak height of 1.0 inches and a width of 0.75 inches. Based upon the specification sheet for HDPE, electrofusion material 60 and thermoplastic components 70 had an effective temperature range of 500 degree Fahrenheit±50 degree Fahrenheit which must be achieved along the entire length of the juncture. The effective temperature was material specific dependent for both thermoplastic component 70 and electrofusion material 60. The material specific melting points for thermoplastic components 70 and electrofusion material 60 used were obtained from manufacturer specification sheets readily available from the individual thermoplastic manufacturers. In the test the resultant effective constant voltage was in the range of about 5.5 to about 11.8 volts. The test result for the effective constant amperage was in the range of about 5.0 to about 17.0 amps. The resulting effective period of time for was between about 13.0 to about 15.0 minutes.

Thus, the HDPE material is suitable for use in the current invention. When used in the method of the current invention, HDPE electrofusion material would be placed and secured in the aforementioned juncture. Securing may be achieved by any non-conductive method such as tape and pressure. Electrical connections 68 are placed upon the two exposed leads 76 and the previously discussed effective voltage and amperage is applied for the effective period of time. The entire process is preferably monitored with a detector to ensure any exposed surface, or gap, does not exceed a surface temperature between 70 percent to 85 percent of the overall melting point of the thermoplastic component 70 and the electrofusion material 60. Preferably monitoring uses one of many infrared cameras commercially available, yet capable of detecting at least to a level of 0.1 degree Fahrenheit.

Once the effective temperature is achieved, electrical current is discontinued. Using a manual or mechanical device, the now semi-molten electrofusion material 60 and thermoplastic components 70 are pressed together. The pressing of the now semi-molten electrofusion material 60 and thermoplastic components 70 forces an intermingling of individual polymers of the electrofusion material 60 and thermoplastic components 70 into each other. The linear electrofusion process is complete once the fused electrofusion material 60 and thermoplastic components 70 cool below the melting point and solidify as an integrated component. This process is repeated as necessary to join any remaining thermoplastic components until the entire assembly of thermoplastic components is linearly fused together.

Figure 11:
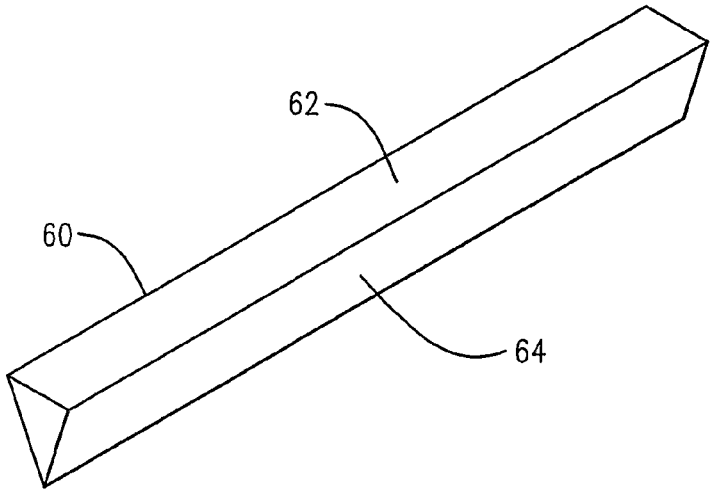
FIG. 11—Is a perspective view of the formed electrofusion material.
Figure 12:
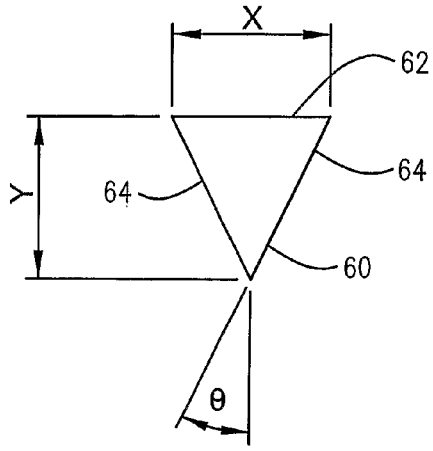
FIG. 12—Is an end view of the formed electrofusion material.

A representative, non-limiting example of how to implement the linear electrofusion process as disclosed above, is discussed below. The example uses three, 10-12 foot long circular thermoplastic components 70 for the linear electrofusion process. FIG. 11 shows a perspective view of a representative formed segment of electrofusion material 60 having two sides 64 and a back edge 62. A preferred electrofusion material 60 for use with circular thermoplastic components is depicted in FIG. 12. This version of electrofusion material 60 is selected to be in the form of an isosceles triangle which is suitable for insertion into the juncture. Within the isosceles triangle, the peak inner angle is 40 degree and the two leg inner angles are 70 degrees each. Although an isosceles triangle is shown, the shape of electrofusion material 60 will change for each juncture of generally linear components to be fused and is not limited to a triangle or any other particular geometric shape.

Continuing with the example, following the forming of electrofusion material 60 into the desired geometric configuration, electrical conducting material 66 or 67 is affixed to sides 64 which will be in contact with the generally linear, circular thermoplastic components 70. The wire is wound through two gears where it undergoes a rotary meshing into a form of alternating waves. Once formed, the alternating waves have a gap of 0.25 inches and a height is 0.75 inches. Once the wire is formed, it is affixed to the electrofusion material 60 by using tape or non-conductive staples. In this example the electrically conducting material 66 is a metal wire. The wire selected for this example is 14 gauge and is capable of achieving the amperage, voltage and temperature requirements discussed above. In this example, formed electrofusion material 60 suitable for use in manufacturing the assembly has a height of about 1.0 inches and a width of about 0.75 inches.

Continuing with the example an alternative approach uses the same formed electrofusion material 60 and an identical gauge wire. However, in the alternative electrofusion material 60 the wire is tautly and straightly pulled across and affixed to electrofusion material 60 with tape or a similar type adhesive material.

Another alternative electrofusion material 60 for this example is formed by placing the wire into a pre-shaped mold. The wire may be wave shaped or straight as long as electrical leads 76 is retained as attachment points. The electrofusion material 60 is in a molten state and it is poured into mold around the wire. In this alternative a mold of the juncture where electrofusion material 60 will be in contact with the generally linear, circular thermoplastic components 70 is constructed. As electrofusion material 60 cools the wire is embedded in electrofusion material 60. The finish product is removed from the mold and used in the linear electrofusion process the same as a formed piece of electrofusion material 60.

Figure 15:
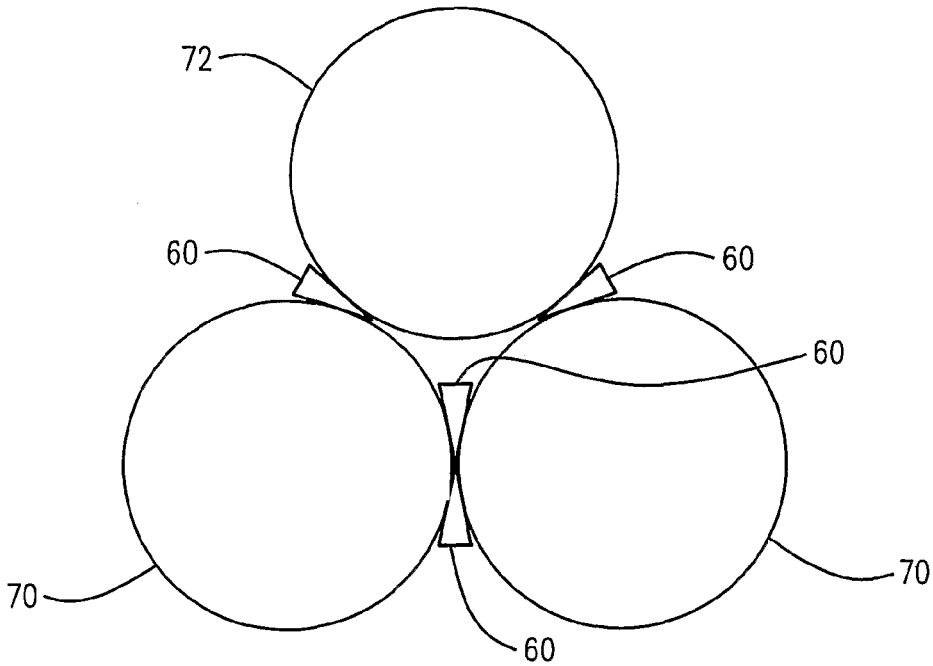
FIG. 15—Is an end view showing the placement of the electrofusion material around the thermoplastic components to effectuate the bonding process.
Figure 16:
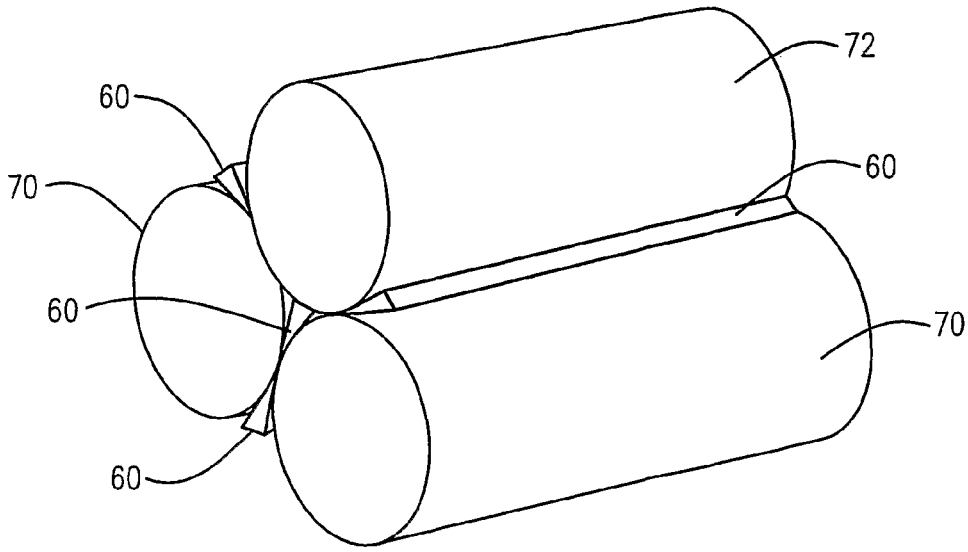
FIG. 16—Is a perspective view of FIG. 15 showing the placement of the electrofusion material around the thermoplastic components to effectuate the bonding process.
Figure 17:
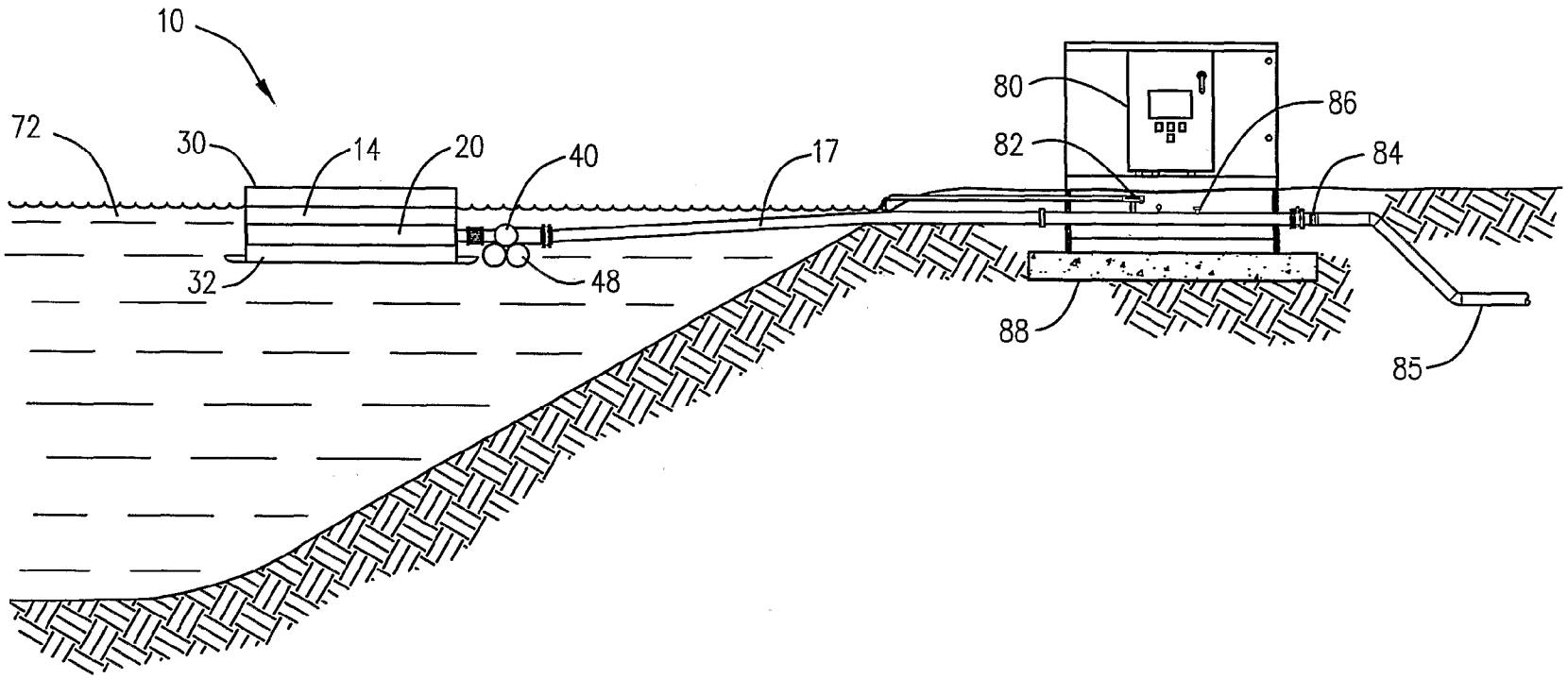
FIG. 17A—Is a side view of a typical installation of the submersible pump with associated conduit and control system floating in a lake, pond or other body of water.
FIG. 17B—Is a side view of a typical installation of the submersible pump with associated conduit and control system resting on the bottom of a lake, pond or other body of water.
Figure 17:
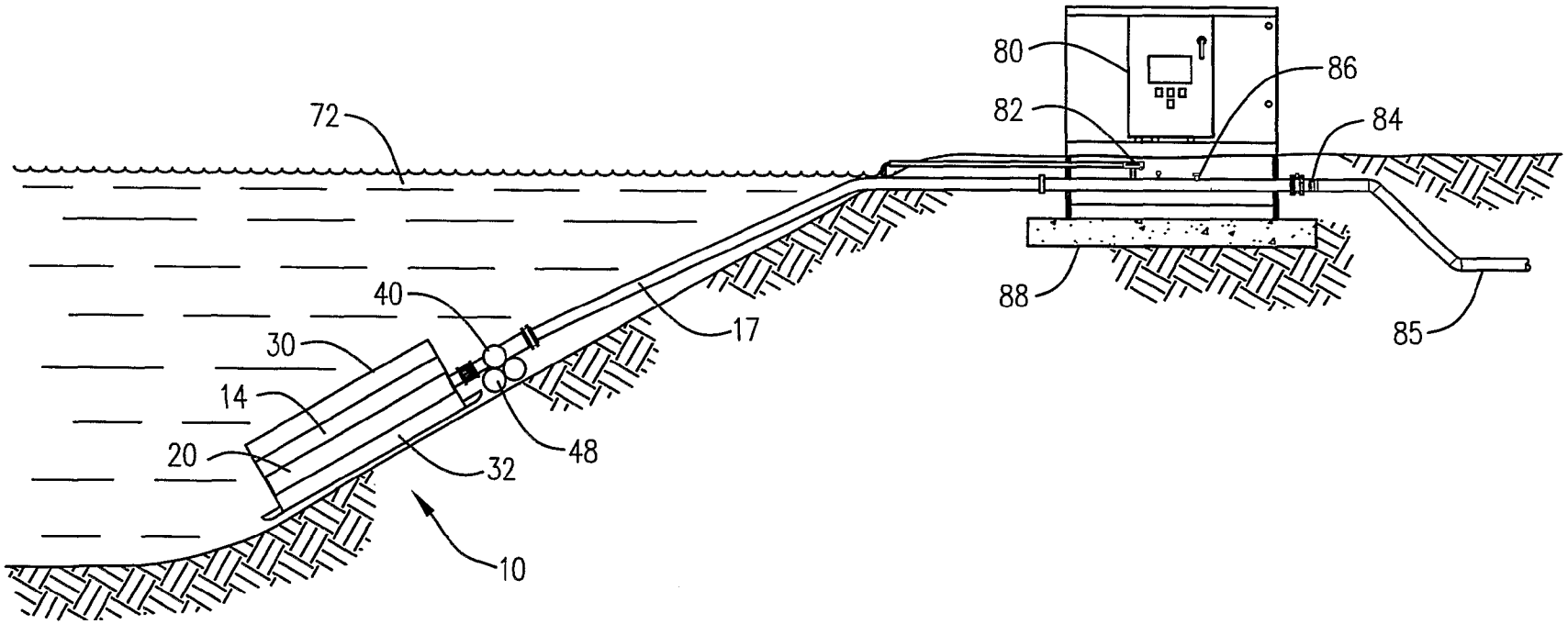
Figure 14:
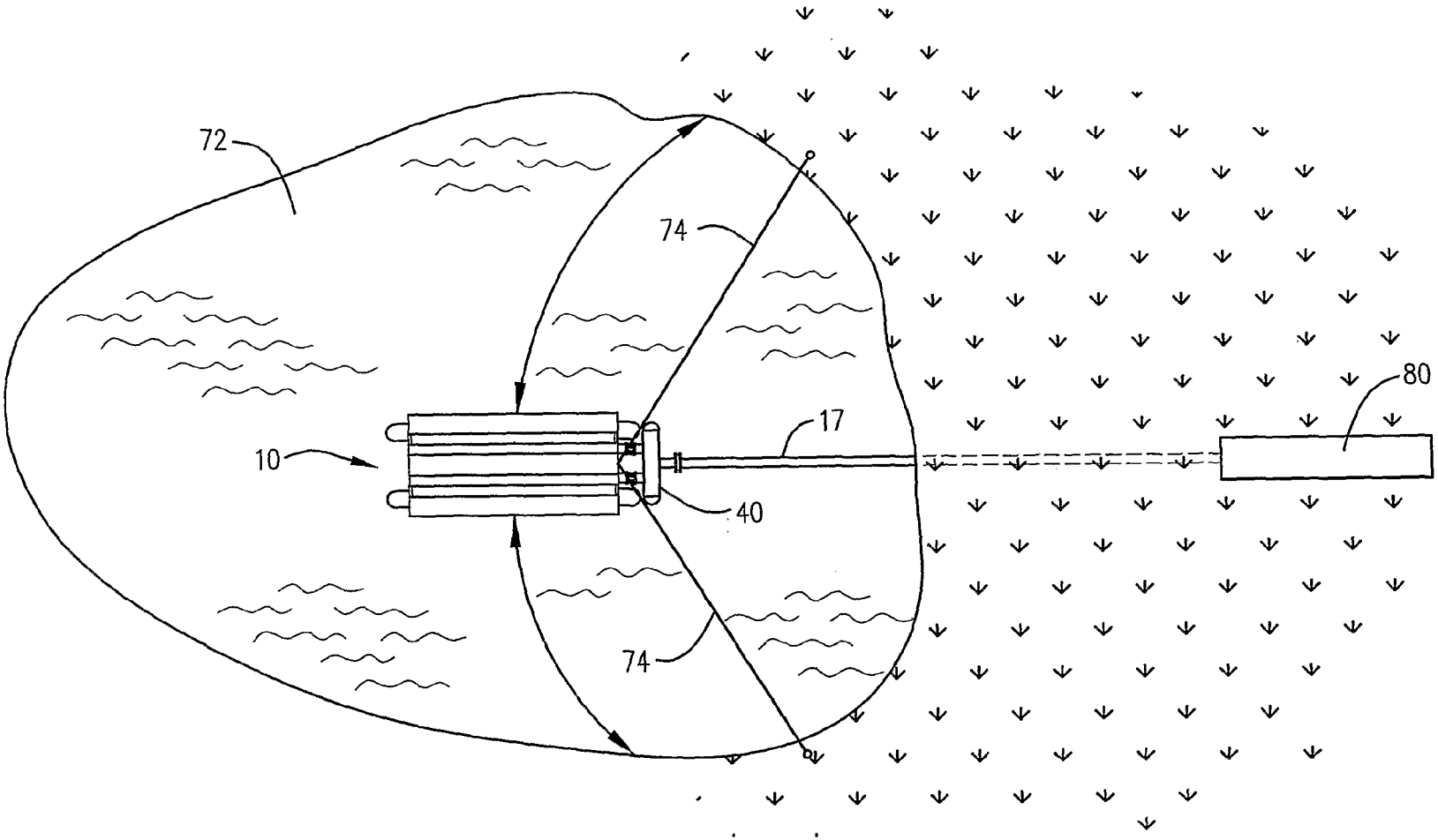

Continuing with the example, once electrofusion material 60 is formed and the wire is affixed, it is inserted into the juncture between thermoplastic components 70 as shown in FIG. 15 and FIG. 16. Electrofusion material 60 is positioned to tangentially contact or touch the thermoplastic components 70. In this example, electrofusion material 60 is secured into place by using a pressure fit. Following positioning electrofusion material 60 and thermoplastic components 70, electrical leads 76 are placed on both ends of wire. Electricity is applied until electrofusion material 60 becomes a semi-molten material. Considering the length of electrofusion material 60 for this example, an effective period of time is about 13 to about 15 minutes. In this example an infrared camera is used to monitor the process and ensure the surface temperature stays in the range of 180 degree Fahrenheit and 195 degree Fahrenheit for all of electrofusion material 60. Additionally, the infrared camera is used to ensure that the surface temperature does not exceed 195 degree Fahrenheit for any gaps between electrofusion material 60 and thermoplastic components 70. The effective temperature is when the electrofusion material 60 and portions of thermoplastic components 70 in contact with electrofusion material 60 reach 500 degree Fahrenheit±50 degree Fahrenheit. For this example the effective voltage is in the range of 5.5 to 11.8 volts. Further, for this example, the effective amperage is in the range of 5.0 to 17.0 amps.

Still continuing with this example, once electrofusion material 60 reaches a semi-molten state, the electricity is disconnected. Under these conditions, the temperature of the semi-molten electrofusion material 60 is sufficient to melt the outer portion of thermoplastic components 70. The semi-molten electrofusion material 60 is pressed into the juncture, forcing an intermingling of individual polymers of thermoplastic components 70 and electrofusion material 60. Pressing is done using any convenient mechanical or hand-held device. The now fused electrofusion material 60 and thermoplastic components 70 are allowed to cool and solidify as integrated components. The process is repeated for each thermoplastic component that linear electrofusion is required to be fused together.

Thus, the present invention is well adapted to carry out the objects and attain the ends and advantages mentioned as well as those inherent therein. While preferred embodiments of the present invention have been illustrated for the purpose of the present disclosure, changes in the arrangement and construction of parts and the performance of steps can be made by those skilled in the art, which changes are encompassed within the scope and spirit of the present invention as defined by the appended claims.

What is claimed is:

1. A submersible pump assembly comprising:
- a pump carrying an inlet and an outlet port;
- a structural filter assembly in fluid communication with said pump inlet port;
- a ballast tank secured to said structural filter assembly; and
- a compressed air source in gaseous communication with said ballast tank.

2. The submersible pump assembly of claim 1, wherein said pump is disposed within said structural filter assembly.

3. The submersible pump assembly of claim 1, further comprising a pump housing with said pump disposed therein, said pump housing carrying a filtered inlet port which is in fluid communication with said pump inlet port, and said pump housing secured to said ballast tank and said structural filter assembly.

4. The submersible pump assembly of claim 1, further comprising a plurality of ballast tanks, wherein each ballast tank further comprises:
- a plurality of ballast compartments in fluid communication with said compressed air source;
- an upper and a lower valve carried by at least one ballast compartment; and
- a valve control mechanism suitable for remotely actuating said upper and lower valves between a closed position and an open position, wherein said upper and lower valves are independently operable.

5. The submersible pump assembly of claim 1, further comprising an automated low-level, low-flow sensor carrying an automated shutdown switch for said submersible pump assembly.

6. The submersible pump assembly of claim 1, further comprising:
- a plurality of pump housings, wherein each pump housing has at least one pump disposed therein; and
- a header in fluid communication with said outlet port of each said pump.

7. The submersible pump assembly of claim 1, further comprising a support structure wherein said support structure positions said submersible pump assembly at an angle of at least 0.5 degree vertical relative to a horizontal plane.

8. A variable buoyancy controlled submersible pump assembly comprising:
- a pump carrying a first end and a second end;
- a structural filter assembly in fluid communication with said pump first end, wherein said pump is disposed within said structural filter assembly;
- a ballast tank secured to said structural filter assembly and carrying an upper valve;
- a compressed air source and a compressed air line, said compressed air line providing fluid communication between said open valve and said compressed air source;
- a first buoyancy device comprising a valve control mechanism suitable for opening and closing said upper valve; and
- a second buoyancy device provided to automatically adjust a depth and attitude of said pump assembly.

9. The variable buoyancy controlled submersible pump assembly of claim 8, further comprising an automated low-level, low-flow sensor carrying an automated shutdown switch for said variable buoyancy controlled submersible pump assembly.

10. The variable buoyancy controlled submersible pump assembly of claim 8, further comprising:
- a plurality of ballast tanks, wherein each ballast tank carries a ballast compartment, each ballast compartment further carries said upper valve, said upper valve capable of being remotely controlled;

wherein said ballast compartment further carries a remotely controlled lower valve on each said ballast compartment; and wherein said valve control mechanism comprises a depth sensor providing an input to said remotely controlled system.

11. The variable buoyancy controlled submersible pump assembly of claim 8, further comprising a pump housing with said pump disposed therein, said pump housing carrying a filtered inlet port which is in fluid communication with said pump first end, and said pump housing fused to said ballast tank and to said structural filter assembly.

12. The variable buoyancy controlled submersible pump assembly of claim 11, wherein said structural filter assembly is in fluid communication with said pump housing and is secured to said pump housing in a manner providing fluid communication with said structural filter assembly.

13. The variable buoyancy controlled submersible pump assembly of claim 8, further comprising:

a plurality of pump housings, wherein each pump housing has at least one said pump disposed therein; and a header in fluid communication with said second end of each said pump.

14. The variable buoyancy controlled submersible pump assembly of claim 13, further comprising a header ballast tank for said header.

15. The variable buoyancy controlled submersible pump assembly of claim 8, further comprising a support structure wherein said support structure positions said variable buoyancy controlled submersible pump assembly at an angle of at least 0.5 degree vertical relative to a horizontal plane.

16. A method for assembling a submersible pump comprising:

positioning longitudinal components of a pump assembly comprised of at least one structural filter assembly and at least one ballast tank;

securing said longitudinal components together in a manner facilitating fluid flow into said pump housing;

disposing a submersible pump having an inlet and an outlet port in said structural filter assembly; and attaching a flow conduit to said output port of said pump.

17. The method of claim 16, wherein the securing step to bond said longitudinal components together is accomplished by an electrofusion process.

18. The method of claim 17, further comprising:

positioning at least one upper ballast tank and at least two lower ballast tanks;

securing a header to said flow conduit when said pump assembly employs a plurality of said pumps; and securing a ballast tank to said header.

19. The method of claim 16, further comprising;

securing a support structure to said pump assembly, wherein said support structure positions said pump assembly at an angle of at least 0.5 degree vertical relative to a horizontal plane; and wherein securing said support structure further comprises securing a flow conduit to said pump assembly, said flow conduit shaped to provide said angle.

20. The method claim 19, further comprising inserting an access mechanism, wherein said flow conduit is joined to said pump housing by said access mechanism positioned between said pump housing and a header thereby providing access to one or more of said pumps without disconnecting said header.

* * * * *